US006630626B2

(12) United States Patent
Johnson et al.

(10) Patent No.: US 6,630,626 B2
(45) Date of Patent: Oct. 7, 2003

(54) SNAP ON BARRIERS FOR TERMINAL BOARDS AND FUSE BLOCKS

(75) Inventors: David M. Johnson, Simpsonville, SC (US); Rodney J. Waters, Hendersonville, NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/683,671

(22) Filed: Feb. 1, 2002

(65) Prior Publication Data

US 2003/0146016 A1 Aug. 7, 2003

(51) Int. Cl.[7] ..... H01R 9/24
(52) U.S. Cl. ..... 174/138 F; 439/718
(58) Field of Search ..... 174/135, 138 F; 439/709, 718, 892

(56) References Cited

U.S. PATENT DOCUMENTS 4,180,305 A * 12/1979 Ustin et al. ..... 439/717
4,322,119 A * 3/1982 Baker ..... 439/73
4,417,781 A * 11/1983 Johnston et al. ..... 439/718
4,696,528 A 9/1987 Harnois
4,774,390 A * 9/1988 Lehman et al. ..... 174/138 F
4,938,715 A * 7/1990 Jones et al. ..... 439/718
5,002,505 A 3/1991 Jones et al.
5,064,384 A * 11/1991 Weaver ..... 439/709
5,215,480 A * 6/1993 Lesslie et al. ..... 439/696

* cited by examiner

*Primary Examiner*—Dean A. Reichard
*Assistant Examiner*—Adolfo Nino
(74) *Attorney, Agent, or Firm*—Fay, Sharpe, Fagan, Minnich & McKee, LLP

(57) ABSTRACT

A barrier for limiting accessibility to electrically conductive boards includes a plurality of board-engaging sides having proximal and distal edges to the board. A cover side is formed between the distal edges. Securements extend from at least one of the sides securing the barrier into a fixed position relative to the board, as well as preventing tactile access to the board. The barrier includes slits that allow wires to enter and exit the barrier as well as allow adequate air flow to pass over the board.

20 Claims, 4 Drawing Sheets

SNAP ON BARRIERS FOR TERMINAL BOARDS AND FUSE BLOCKS

BACKGROUND OF THE INVENTION

The present invention relates to electrical shielding, specifically, physical barriers for the prevention of tactile interface with leads on terminal boards which are drawing current, often called "hot" leads, and will be described with particular reference thereto. It is to be appreciated that the present invention is also applicable to various other uses and is not limited to the aforementioned application.

Electrical terminal boards are used as hubs for a plurality of wire junctions. Current flow through such terminal boards can reach dangerous levels, such that contact with open leads of the terminal boards can cause injury or even death. In an effort to circumvent such incidences, an Underwriters Label (UL) requirement mandates that such "hot" leads be covered with an insulator to prevent electrical shock. Currently, in accordance with UL Code 56 applied aptly dubbed the "fickle finger" test, a finger shaped probe is used to prod a covered terminal board or other electrical device. If the probe successfully touches any hot leads, then the device fails the test.

Presently, large covers may be provided to encompass a plurality of terminal boards located in the same vicinity. If a technician wishes to access a single terminal board, he removes the cover exposing all of the terminal boards. Typically, power to all of the terminal boards under the cover is cut for the safety of the technician, even though the technician only needs to access one terminal board. This means that working systems could be down while completely unassociated systems are being repaired or maintained. In order for such a barrier to be practical, a relatively large number of terminal boards are contained within the cover, which means a large number of non-associated systems are down while one terminal board is being accessed.

Another method of guarding terminal boards is to supply cardboard covers roughly shaped to bar access to hot leads. Cardboard barriers are easily misshapen, and do not withstand humid environs well. Further, additional means of attachment are used to secure the cardboard about the terminal board.

Either of the aforementioned methods requires the removal of the cover to access the terminal board.

Fuse blocks present similar problems to those discussed above in that they have exposed leads when in operation. Additionally, a UL specification requires that in a dual fuse system, both fuses are to be removed simultaneously. With typical fuse pullers, it is possible to rotate the puller only freeing one fuse, leaving the second fuse in the circuit.

The present invention provides a new and improved method and apparatus which overcomes the above-referenced problems and others.

SUMMARY OF INVENTION

In accordance with one aspect of the present invention, a barrier for limiting accessibility to electrically conductive boards is provided. The barrier includes a plurality of board-engaging sides having proximal and distal edges to the board. A cover side is formed between the distal edges. Securements secure the barrier to the board.

In accordance with another aspect of the present invention, a method of preventing access to an electrically conductive board is provided. A barrier is attached to a board that prevents tactile access to the board. The barrier includes board-engaging sides, a cover side and securements to hold it in place on the board.

BRIEF DESCRIPTION OF DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION

Figure 2:
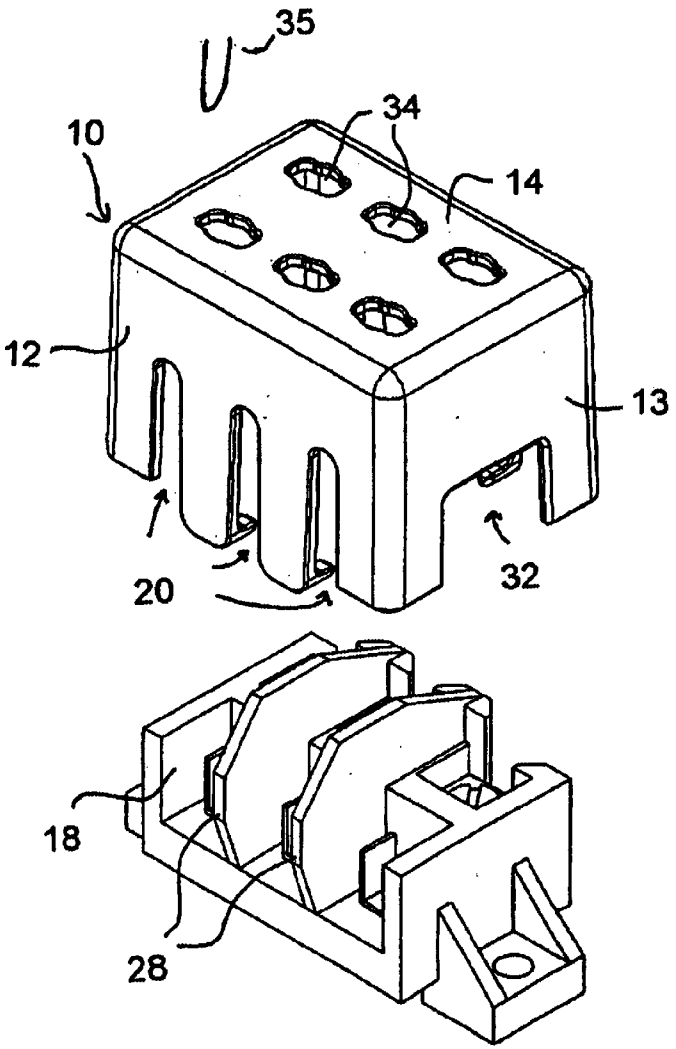
FIG. 2 is a 180° rotation of FIG. 1.
Figure 1:
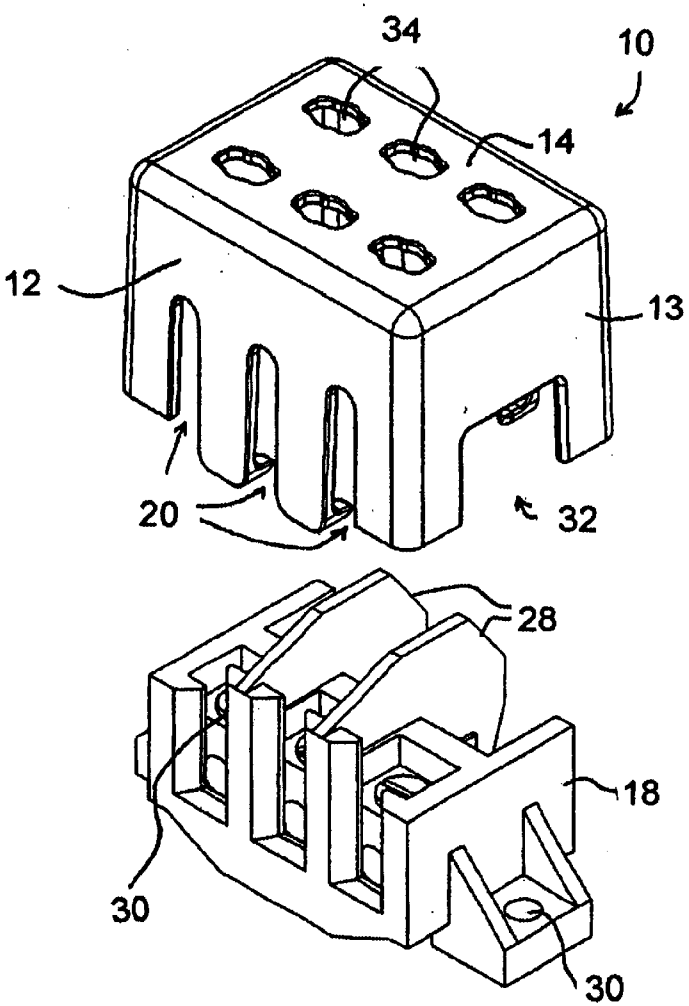
FIG. 1 is a perspective view of the barrier engaging with a terminal board in accordance with the present invention.

With reference to FIGS. 1 and 2, a barrier 10 is generally depicted. The barrier is constructed of a flexible non-conducting material, wherein in one embodiment such may be VALOX™ of a family of thermoplastic polyester resins that are semi-crystalline materials based on polybutylene terephthalate polymers. The barrier 10 includes four board-engaging sides, defined as two sidewalls 12 and two end walls 13. Each board engaging side has a proximal edge and a distal edge relative to a board which the barrier 10 covers. Integrally formed to the four proximal edges is a cover side 14. Together, the board-engaging sides 12, 13 and the cover side 14 combine to form a five sided construct which when engaged with an electrical board, prevents tactile access with current carrying components located on the board. In a first embodiment of the barrier, it is used in conjunction with terminal board 18.

Figure 3:
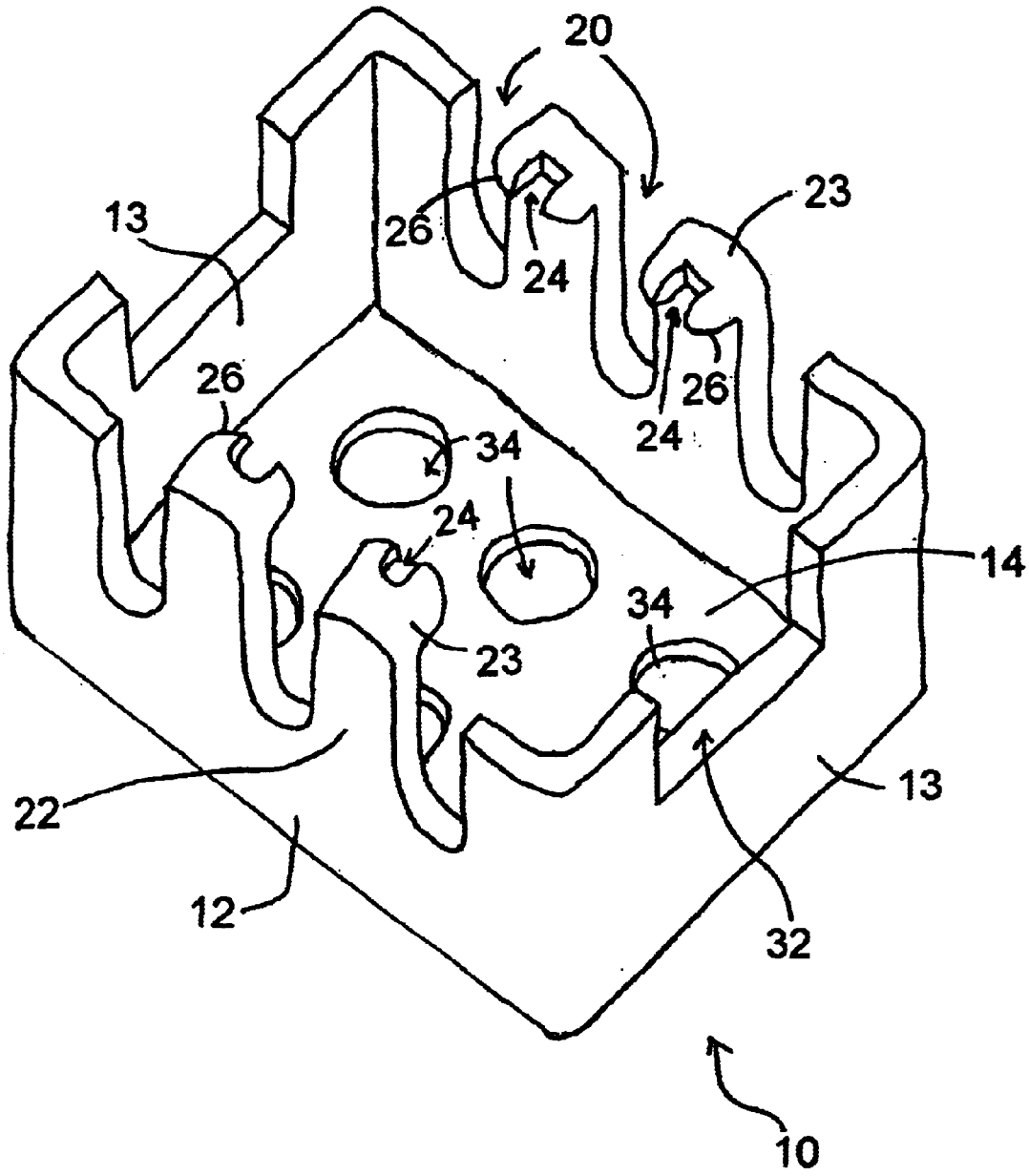
FIG. 3 is a perspective view of the barrier.
Figure 4:
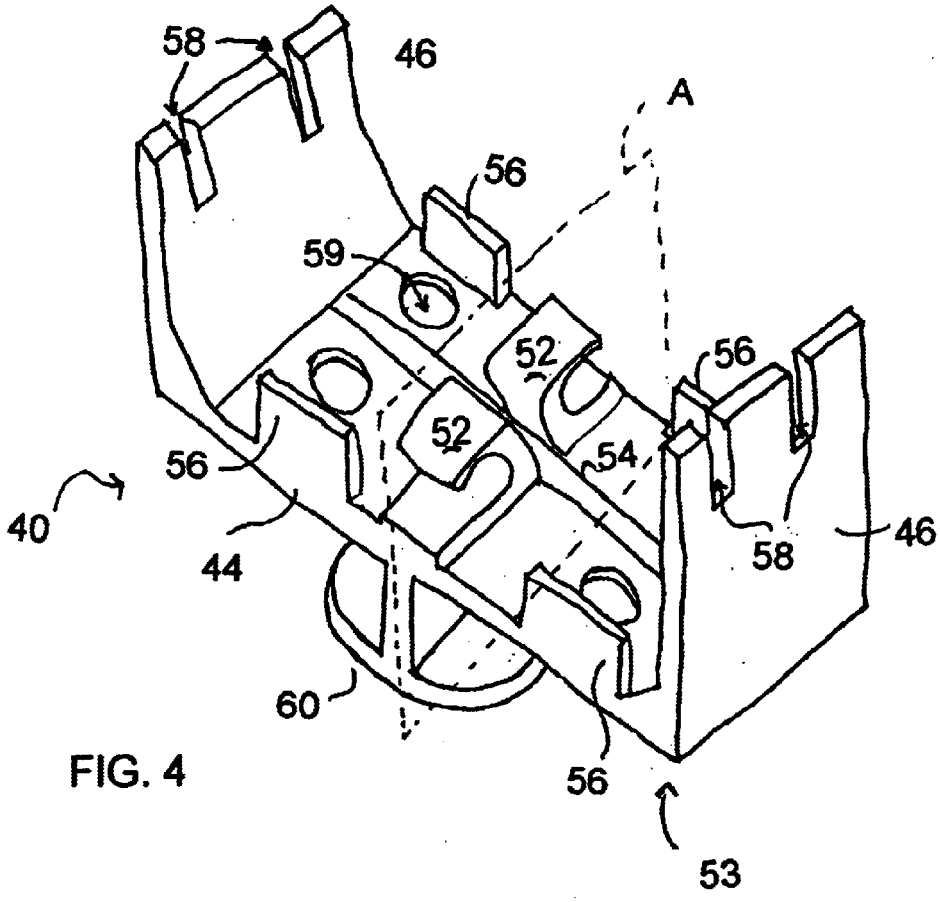
FIG. 4 is a perspective view of another preferred embodiment of the barrier for use in conjunction with a fuse block, in accordance with the present invention.
Figure 5:
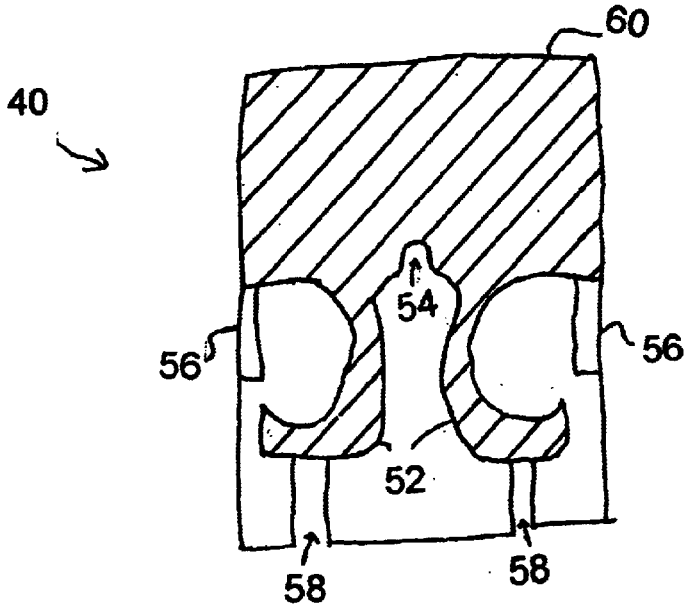
FIG. 5 is a cross-sectional view of the plane A in FIG. 4.
Figure 7:
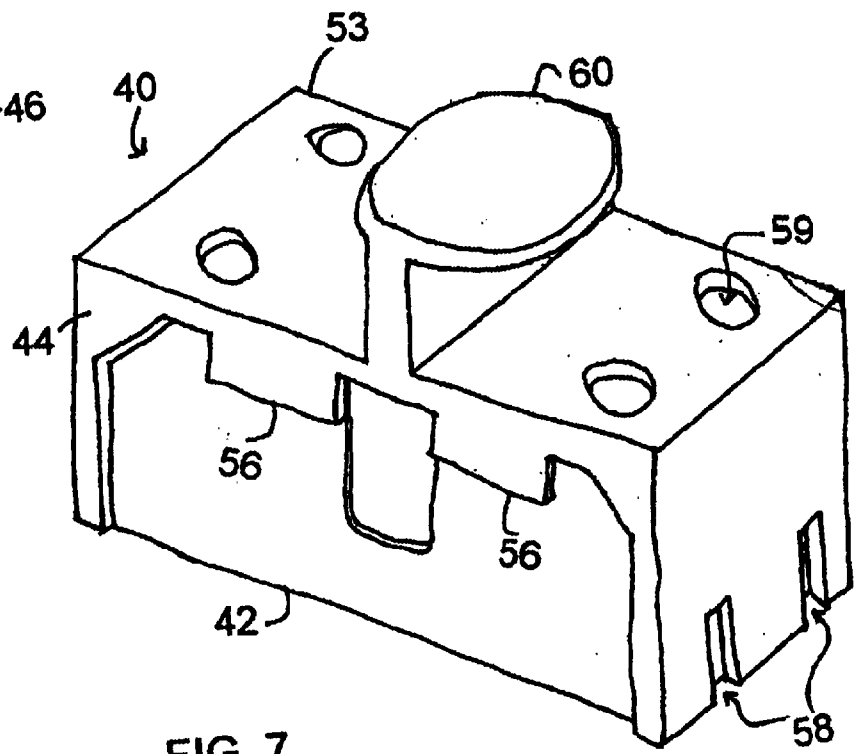
FIG. 7 is a perspective view of the barrier locked into position on the fuse block.
Figure 6:
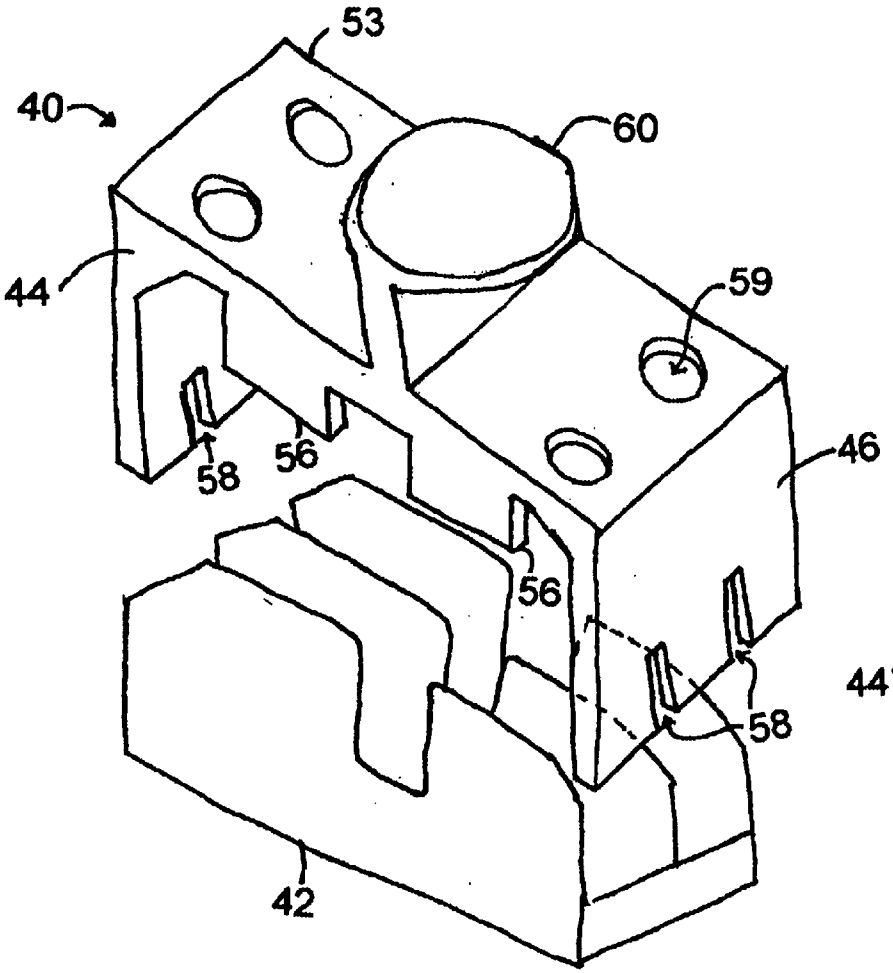
FIG. 6 is a perspective view of the barrier engaging a fuse block.

With reference to FIG. 3, and with continuing reference to FIGS. 1 and 2, slits 20 are provided in the sidewalls 12 of the four board-engaging sides. Flexible tines 22 result from providing the slits 20. The tines 22 flex a limited distance towards and away from the tines 22 on the opposite board-engaging side wall. On a head 23 of each tine 22 a notch 24 is provided. The notch 24 divides the head into at least two prongs or securements 26.

As best seen in FIGS. 1 and 2, the tines 22 engage complementary slats 28 of the terminal board 18. The slats 28 mate with the notches to guide the barrier 10 downward into a locked or fixed position on the terminal board 18. In the locked or fixed position, at least some of the prongs 26 extend underneath the terminal board 18 securing the barrier 10 to the terminal board 18. In order to accommodate screw blocks 30 of the terminal board, gaps 32 are provided in the end walls 13 of board-engaging sides 12 adjacent to the slatted sides. In this manner, the barrier 10 fits firmly about the terminal board 18 preventing tactile access to the current carrying components.

The cover side 14 includes openings 34 for accessing components of the terminal board 18 without removing the barrier 10. The openings 34 are sufficiently large to allow a screwdriver or other tool to be inserted, but not large enough for one to insert a finger. In the preferred embodiment, the openings 34 are shaped such that a flathead screwdriver may be inserted in the opening 34, and the screwdriver rotated once the head of the screwdriver is entirely below the plane of the opening 34. In other words, the openings 34 are a combination of the greater dimensions of a rectangle overlapped upon a circle with common centers. The diameter of the circle portion is preferably slightly larger than the short dimension of the rectangle. The long dimension of the rectangle portion is preferably 1 cm, and the diameter of the circle portion is 6 mm. It is to be understood that these values may be larger or smaller, depending on the size of the flathead screwdriver they were meant to accommodate. However, the dimensions must be sufficiently small to prevent access of the fickle finger to the hot leads. Preferably, the opening will allow rotation of the shaft of the screwdriver, but not the entire head of the screwdriver. Otherwise, the openings 34 would be large enough to provide egress to the fickle finger.

In addition to providing the tines 22 with flexibility, the slits 20 provide openings for wires to enter and exit the barrier 10, connecting with the terminal board 18. The slits 20 are adequately sized to provide for any desirable gauge wire, while remaining small enough to pass the UL code 56 fickle finger test. Again, this test uses a finger-shaped probe 35, to determine whether a human finger is able to pass into the terminal board area. The finger-shaped probe is sized to that of an average one-year-old child. Additionally, the slits 20, gaps 32 and openings 34 allow sufficient air flow to reach the current carrying elements to prevent overheating. As seen in FIGS. 1 and 2, the barrier 10 is symmetrical about its long axis and can be applied in either the orientation of FIG. 1 or the orientation of FIG. 2, that is, 180° rotated from FIG. 1.

In a second embodiment, with reference to FIGS. 4–7, a barrier 40 is provided to engage a fuse block 42 and prevent tactile access thereto. As with barrier 10 of this embodiment, the second preferred embodiment includes four board-engaging sides, defined as two sidewalls 44, and two end walls 46. The cover side 44 is elongated in one dimension to accommodate common fuse blocks, for example, a 20 Amp. Bussmann® fuse block made by Cooper Industries. Fuse securements 52 extend from a cover side 53. The securements 52 hold a pair of fuses (not shown) in a fixed position relative to the barrier 40, and in a parallel relationship relative to each other. The securements 52 hold the fuses in the orientation in which they are to be inserted in the fuse block 42. The securements 52 are symmetrically disposed about a center channel 54. The center channel 54 runs along the long axis of the cover piece 53. The center channel accommodates a center wall of the fuse block 42, should one be included.

The fuses, while concurrently being secured relative to the barrier 40, are locked into the fuse block 42. Standard fuse blocks include conducting clasps that secure the fuses into position relative to the fuse block. The fuses are secured relative to both the fuse block 42 and the barrier 40, thus, the barrier 40 is transitively secured to the fuse block 42. The sidewalls 42 of the adjacent to the long dimension of the cover side 53 include at least two tabs 56. The tabs 56 prevent rotation of the barrier 40. By preventing such a rotation, the fuses are ensured to be removed simultaneously, if they are to be removed at all. The tabs 56 prevent one from rocking the cover from side to side removing only one fuse.

The end walls 44 adjacent to the short dimension of the cover side 53 include slats 58 which allow wires to enter and exit the fuse block. In the illustrated embodiment, two slats 58 on each side are included, but it is to be understood that more or less slats may be provided, depending on the application, more specifically, the number of wires needed. The slats 58 will of course be sized to pass the UL Code 56 tests.

Openings 59 are included in the cover side 52 that allow access to the connection elements without removing the barrier 40, and in the present case, disrupting the circuit. Additionally, the present preferred embodiment is also symmetrical about its long axis, allowing it to be applied either of two ways. A handle 60 extends away from the cover side 53, facilitating the removal of the barrier 40. The handle 60 requires the application of a manual force away from the fuse block 42 to remove the barrier, and thus, pull the fuses out of the block 42.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A barrier for limiting accessibility to electrically conductive boards comprising:

a plurality of board-engaging sides, each of the board-engaging sides having a proximal edge to the board and a distal edge, at least one of the plurality of sides is being slit from the proximal edge providing an opening for electrically insulated wires to enter and exit the barrier;

a cover side integrally formed with the distal edges of the board-engaging sides, wherein the cover side and board-engaging sides combine to prevent tactile access to the current carrying components of the board; and securements extending from at least one of the sides that assist in securing the barrier in position relative to the board.

2. The barrier as set forth in claim 1, wherein the securements extend from the proximal edges, attaching the barrier to the board such that the barrier is capable of being repeatedly attached and detached from the board.

3. The barrier as set forth in claim 2, wherein the securements of the board-engaging sides are notched such that the securements are integrally formed by a plurality of prongs, the prongs engaging complementary structures on the board when the barrier is attached to the board.

4. The barrier as set forth in claim 1, wherein the securements extend from the cover side, securing circuit elements, fixed to the board, to the barrier, thereby transitively securing the barrier to the board.

5. The barrier as set forth in claim 4, further including:

a manual release handle extending from the cover side to which force is applied away from the board removing the circuit elements from the board, thus removing the barrier from the board.

6. The barrier as set forth in claim 4, wherein at least two of the board-engaging sides include tabs which force simultaneous removal of the circuit elements.

7. The barrier as set forth in claim 1, wherein the cover side includes at least one opening through which the board is accessed without detaching the barrier from the board, at least one opening being shaped such as:

to allow the insertion of a flathead screwdriver therethrough and the rotation of a shaft of the flathead screwdriver once a head of the flathead screwdriver is entirely below a plane of the at least one opening; and to prevent the rotation of the head of the flathead screwdriver when the head is within the plane of the at least one opening.

8. The barrier as set forth in claim 1, wherein the barrier is bilaterally symmetrical about a long axis of the cover side such that the barrier may be attached to the board at 0° and 180° orientations.

9. The barrier according to claim 1, wherein the barrier is constructed of a flexible, non-conducting polymer.

10. The barrier as set forth in claim 9, wherein the barrier is constructed of a material from the family of thermoplastic polyester resins that are semi-crystalline materials based on polybutylene terephthalate polymers.

11. The barrier as set forth in claim 9, further including:

a plurality of slits in at least one of the board-engaging sides allowing the at least one board-engaging side to flex from its original configuration, extending about complementary constructions of the board.

12. The barrier according to claim 1 wherein the cover side includes at least one opening, and wherein the at least one opening is a combination of the greater dimensions of a rectangle overlapped upon a circle with common centers, the diameter of the circle preferably larger than a short dimension of the rectangle.

13. The barrier according to claim 1 wherein the cover side includes at least one opening sized to prevent access of a finger of an average one-year-old child, while still permitting access of a tool to an interior of the barrier to access the board.

14. A method of preventing access to an electrically conductive board comprising:

attaching a non-conductive barrier to the board, wherein the barrier includes:

board-engaging sides, each board-engaging side having a proximal edge to the board and a distal edge;

at least one of the plurality of sides is being slit from the proximal edge providing an opening for electrically insulated wires to enter and exit the barrier;

a cover side integrally formed with the distal edges of the board-engaging sides;

securements extending from at least one of the sides; and wherein the barrier prevents tactile access to circuit components contained on the board.

15. The method as set forth in claim 14, further including:

extending the securements from at least one of the proximal edges;

providing at least one notch in each securement thereby defining at least two prongs in each securement.

16. The method as set forth in claim 15, further including:

providing slits in at least one board-engaging side defining legs in the at least one board-engaging side, the legs terminating in a securement;

extending the legs from equilibrium states, flexing them about complementary structures in the board; and returning the legs to the equilibrium state securing the barrier to the board.

17. The method as set forth in claim 16, further including:

extending electrically insulated wires from the board through at least one of the slits.

18. The method as set forth in claim 14, further including:

extending the securements from the cover side towards the board, the securements immobilizing circuit components relative to the board, thereby transitively securing the barrier relative to the board.

19. The method as set forth in claim 18, further including:

providing slits in at least one of the board-engaging sides; and extending electrically insulated wires through the slits.

20. The method as set forth in claim 18, further including:

forcing simultaneous removal of the circuit components.

* * * * *